US006123543A

United States Patent [19]

Menari et al.

[11] Patent Number: 6,123,543

[45] Date of Patent: Sep. 26, 2000

[54] FLAME OUTLET RAIL FOR GAS BURNER OF THE ATMOSPHERIC, PRE-MIX TYPE

[75] Inventors: Lila Menari; Stephen Daëmon Andrews, both of Nantes, France

[73] Assignee: Sauniter Duval Eau Chaude Chauffage SDECC, Fontenay-sous-Bois Cedex, France

[21] Appl. No.: 09/295,097

[22] Filed: Apr. 21, 1999

[30] Foreign Application Priority Data

Apr. 28, 1998 [FR] France ..... 98 05295

[51] Int. Cl.[7] ..... F23D 14/84; F23D 14/10; F23D 14/14

[52] U.S. Cl. ..... 431/326; 431/8; 431/350; 431/354; 431/328

[58] Field of Search ..... 431/326, 328, 431/349, 350, 354, 7, 8, 10, 266; 239/568, 566, 601, 597, 560, 556, 557, 567; 126/39 E

[56] References Cited

U.S. PATENT DOCUMENTS

| | | | |
|---|---|---|---|
| 2,644,515 | 7/1953 | Lampert et al. . | |
| 3,780,954 | 12/1973 | Genbauffs | 239/560 |
| 4,293,297 | 10/1981 | Polidoro | 431/286 |
| 5,215,457 | 6/1993 | Sebastiani | 431/7 |

FOREIGN PATENT DOCUMENTS

| | | | |
|---|---|---|---|
| 0 773 404 | 5/1997 | European Pat. Off. . | |
| 2 319 080 | 2/1977 | France . | |
| 1 816 948 | 6/1970 | Germany . | |
| 2132968 | 1/1972 | Germany | 431/326 |
| 2360899 | 6/1974 | Germany | 239/568 |
| 2629988 | 1/1978 | Germany | 239/557 |
| 92 02 096 | 4/1992 | Germany . | |
| 1255602 | 12/1971 | United Kingdom | 239/568 |
| 1414979 | 11/1975 | United Kingdom | 431/354 |
| 1473959 | 5/1977 | United Kingdom | 239/556 |

*Primary Examiner*—Carl D. Price
*Attorney, Agent, or Firm*—Arent Fox Kintner Plotkin & Kahn PLLC

[57] ABSTRACT

Flame outlet rail for a gas burner of the atmospheric, pre-mix type. The rail includes a shell defining a plenum closed at one end and open at another end to receive an air/fuel mixture and having a length between the ends. The shell has a longitudinal orifice extending along the length of the shell. A grid made of sheet metal pierced by a series of rectangular slits is positioned over the longitudinal orifice of the shell and communicates an interior of the shell with the exterior thereof to permit the air/fuel mixture to flow therethrough so as to form a flame front upon ignition. The grid has a longitudinal axis in parallel with the longitudinal orifice and a length. The slits which extend perpendicular to the longitudinal axis, are distributed on either side of the longitudinal axis and form a sinusoid extending over the entire length of the grid, which increases a length of the flame front. The slits (2) are spaced apart by a distance, e, constant along the longitudinal axis (3) of the flame outlet grid.

4 Claims, 3 Drawing Sheets

FLAME OUTLET RAIL FOR GAS BURNER OF THE ATMOSPHERIC, PRE-MIX TYPE

FIELD OF THE INVENTION present invention relates to a gas burner of the atmospheric, pre-mix type, and more especially concerns the distribution of the flame outlet orifices on the rail of the burner.

Gas burners, in particular those for bath heaters or boilers, are usually constituted by two dished half-shells delimiting the air-gas mixing chamber, the shells being assembled to form a longitudinal orifice, which is surmounted by a sheet metal grid provided with a plurality of gas outlet orifices. The rails of the burner thus produced are generally placed side by side and parallel to one another to form an assembly capable of functioning with different types of gas.

A certain number of precautions have to be taken in order to ensure correct operation. Firstly, it is necessary to avoid the known phenomenon of 'catching fire' at the injectors, or nozzles, in the case of gases having a high flame propagation velocity, that is to say that the flame outlet orifices in the rail have to be reduced however, there is an increase in the speed of discharge of the primary gas-air mixture which tends to produce the phenomena of 'detachment' and 'blowing' when the gas used has a low flame propagation velocity. Secondly, each burner rail has to be suitably supplied with air, i.e. the flame of the burner must entrain a sufficient amount of secondary air to be able to develop normally, without any risk of 'detachment'. Finally, the mutual ignition of the neighbouring burner rails must take place correctly so that, even with a small gas flow rate, all of the rails ignite without any difficulty.

One conventional way of constructing a burner rail is to pierce the flame outlet grid with a series of orifices in the shape of rectangular slits aligned adjacent to one another. The length of the strip covered by the orifices delimits the overall length of the flame obtained. The surface area covered by this flame evidently corresponds to the product of the said overall length and the width, which is simply the length of a slit. The flame is thus concentrated, and the flame front is delimited by the perimeter of the slits thus aligned. The surface area of contact between the air and the flame corresponds to this perimeter, which limits the ingress of cooling air; as a result, the portions of sheet metal adjacent to the slits are heated to a high temperature and subjected to thermo-mechanical stress; the production of $No_x$ associated with the temperature of the flame is thus appreciable.

BRIEF SUMMARY OF THE INVENTION

The invention provides a new solution concerning the arrangement of the flame outlet orifices, a solution which makes it possible to increase the flame front while, at the same time, reducing its width, and which contributes to improving the stability of the flame, better cooling and reduced $No_x$ emission.

The invention thus relates to a flame outlet rail for a gas burner of the atmospheric, pre-mix type, comprising a grid made of sheet metal pierced by a series of rectangular slits, a rail wherein the slits are distributed on either side of the longitudinal axis of the grid and form a sinusoid extending over the entire length of the grid, thus increasing the length of the flame front.

Advantageously, the slits are spaced apart by a constant distance along the axis of the grid.

According to one preferred alternative embodiment, the slits are identical, each of them being offset in relation to its immediate neighbour.

Other variants and other advantages of the invention will be more clearly apparent from a study of the following description, wherein reference is made to the annexed drawings, which show:

DETAILED DESCRIPTION OF INVENTION

Figure 1:
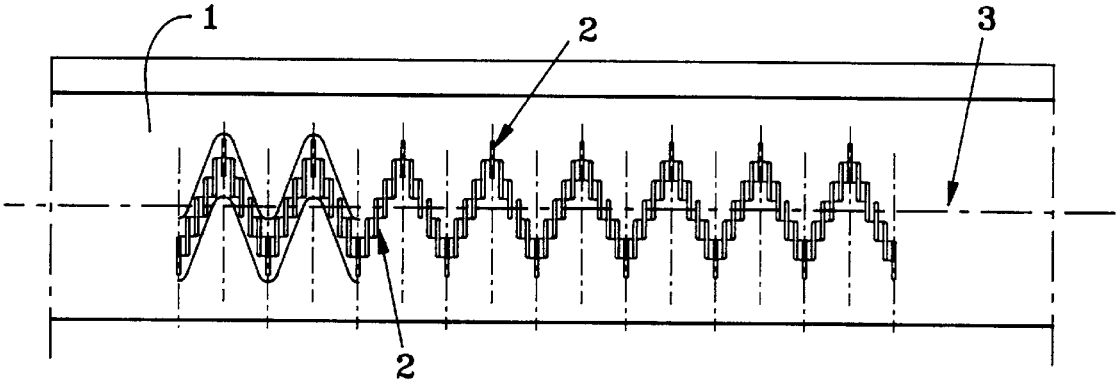
FIG. 1, a top view of a burner rail.
Figure 2:
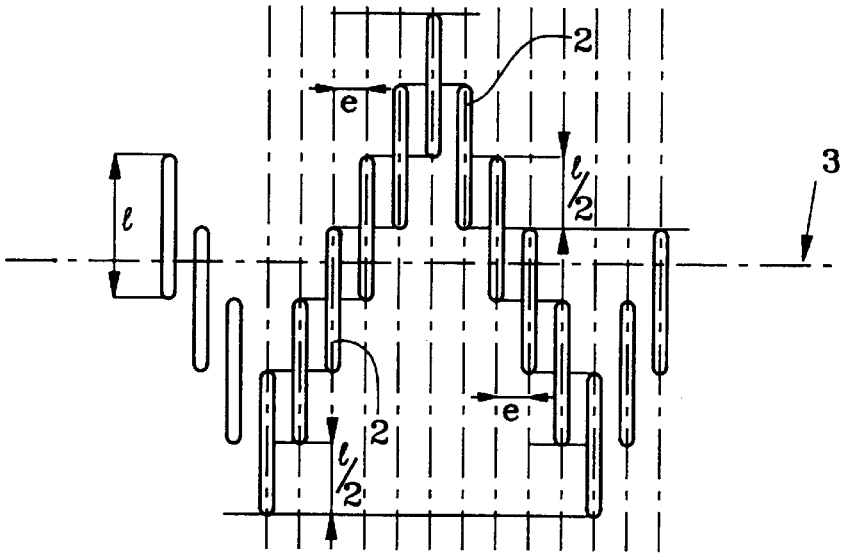
FIG. 2, a larger-scale top view of the slits of the rail according to FIG. 1.

FIG. 1 shows a flame outlet grid formed by a strip, 1, of sheet metal in which slits, 2, have been cut out, these slots being distributed on either side of the longitudinal axis, 3, of the grid, and disposed saw-tooth fashion. FIG. 2 shows these slits 2 as being generally rectangular in shape. The slits are identical and spaced apart by a constant distance, e, along axis 3. On the other hand, perpendicularly to the said axis, each slit is offset in relation to its immediate neighbour by half a slit length, ½. The said half-length ½ is preferable, but not compulsory. For example, it could vary between ⅕ and ⅙.5. What is important is that the ends of the slits should thus form a sinusoid on either side of axis 3, as can be seen in the left-hand part of FIG. 1, the said sinusoid extending over the entire length of the grid. The slits are dimensioned so as to prevent backfiring, 'detachment' or 'blowing'. The offset thus produced between the slits, as opposed to conventional alignment, increases the length of the flame front, since the front corresponds to the sinusoid of the slits.

The said developed perimeter can be equal to three times the length of the flame front of a traditional grid, if not more, thus making it possible to obtain a high primary air rate. Similarly, the surface area covered by the flame is considerably increased, by up to six times. On the other hand, the width of the flame is reduced by 70%.

The flame is thus "stretched" along a sinusoidal path having greater contact with the surrounding atmosphere, allowing greater access to the secondary air thus favouring combustion, as well as cooling. As the flame is shorter, the burner can be placed closer to the heat exchanger, which increases its efficiency and makes for a more compact apparatus. Similarly, the hot combustion products are cooled and discharged more quickly. Since there are also more surfaces of contact between each slit and the neighbouring metallic portion, temperature distribution and burner cooling are enhanced. The heating of the metal constituting the flame outlets is thus acceptable. As there is less thermo-mechanical stress, the useful life of the burner is prolonged.

Thanks to this arrangement, better flame stability is obtained. Owing to the increase in secondary air, the CO is eliminated and $No_x$ emission is reduced.

Figure 3:
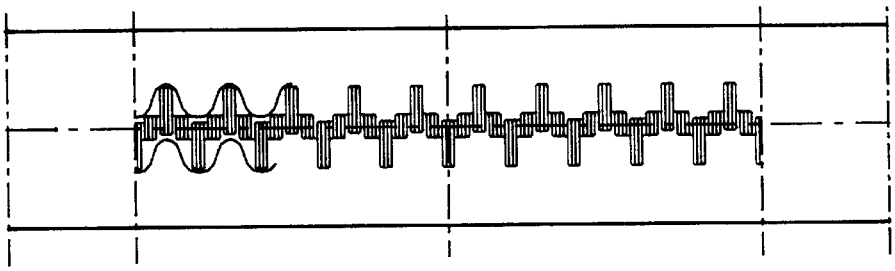
FIGS. 3 and 4, top views of a burner rail variant, these being an overall view and a larger-scale view, respectively.
Figure 4:
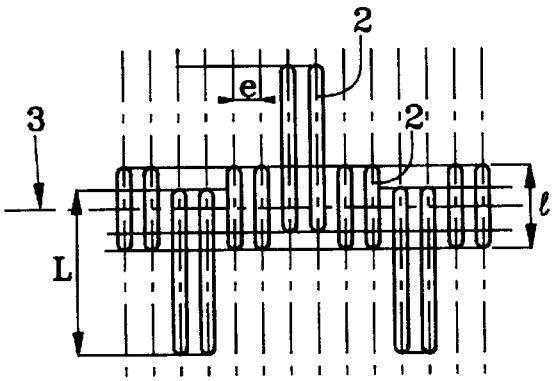

In the alternative form of embodiment illustrated in FIGS. 3 and 4, the slits 2 are of different lengths. There are slits having a length L and shorter slits, with a length 1, the latter being centred on axis 3. The longer slits are grouped in pairs, alternating with the short slits, and they are offset alternately on either side of the axis. The ends of the slits spaced out along axis thus also form a sinusoid, but one that is less regular than that of FIG. 1.

Figure 5:
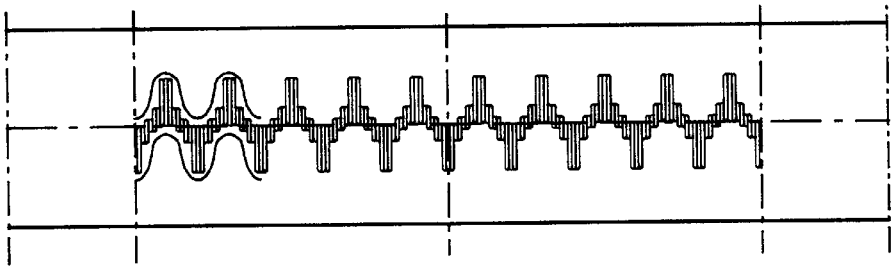
FIGS. 5 and 6, analogous views of another burner rail variant.
Figure 6:
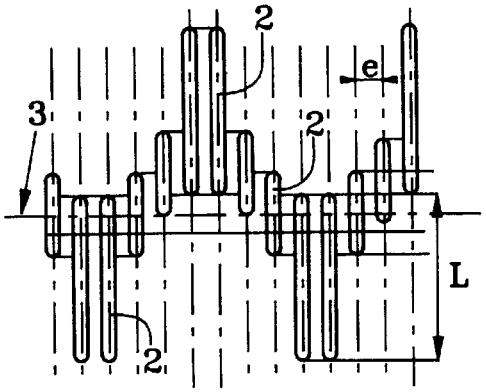

The two slit lengths also feature in another alternative form of embodiment, shown in FIGS. 5 and 6. In this case, most of the slits are offset in relation to axis 3 and the spacing out of their ends is less marked than in the preceding case.

In both cases, the spacing e between the slits remains the same.

The lower part of the burner constructed with a flame outlet grid of this type is composed of a conventionally shaped shell the dimensions of which have been optimised to obtain a primary air supply rate close to stoichiometric conditions and uniform distribution of the air/gas mixture at the outlet. At maximum power, the flames obtained have the chief characteristic of being disposed "saw-tooth" fashion and of thus offering a maximum surface of contact with the surrounding air.

Figure 7:
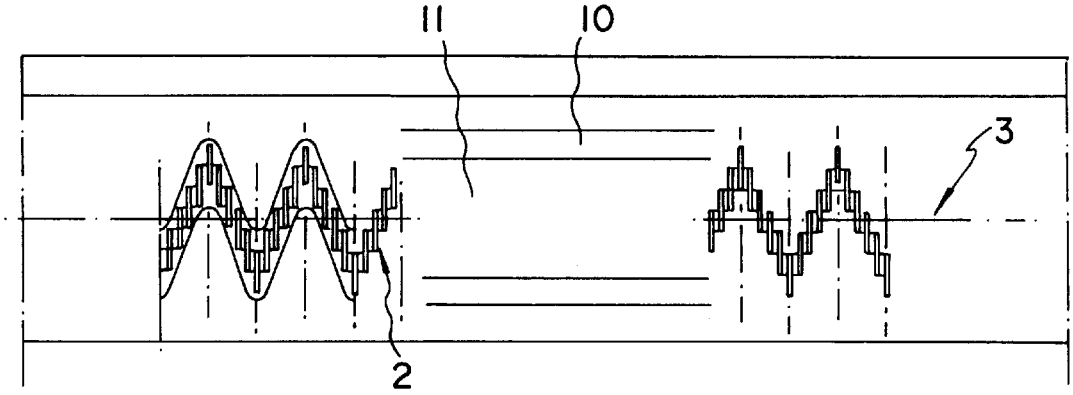
FIG. 7 depicts a cut-away view of the burner rail

FIG. 7 depicts the plenum shell 10 having an orifice 11 extending longitudinally. The separator grid formed of sheet metal 1 has slits 2.

What is claimed is:

1. Flame outlet rail for a gas burner of the atmospheric, pre-mix type, comprising a shell defining a plenum closed at one end and open at another end to receive an air/fuel mixture and having a length between said ends, said shell having a longitudinal orifice extending along the length of said shell, and a grid made of sheet metal pierced by a series of rectangular slits positioned step-wise over said longitudinal orifice of said shell and communicating an interior of said shell with the exterior thereof to permit the air/fuel mixture to flow therethrough so as to form a flame front upon ignition, said grid having a longitudinal axis in parallel with said longitudinal orifice and a length, wherein said slits extend perpendicular to the longitudinal axis, and form a sinusoid extending over the entire length of the grid, which increases a length of the flame front.

2. Flame outlet rail according to claim 1, wherein the slits are spaced apart by a constant distance, e, along the axis.

3. Flame outlet rail according to claim 1, wherein the slits are identical, each slit being offset in a direction laterally of the longitudinal axis relative to an immediate neighbor.

4. Flame outlet rail according to claim 1, wherein the slits are of two different lengths and a majority of the slits are offset in relation to the axis.

* * * * *